US007137521B2

(12) United States Patent
Yourist

(10) Patent No.: US 7,137,521 B2
(45) Date of Patent: Nov. 21, 2006

(54) PLASTIC CONTAINER HAVING CHAMFERED CORNERS FOR IMPROVED TOP-LOADING STRENGTH

(75) Inventor: Sheldon Yourist, York, PA (US)

(73) Assignee: Graham Packaging Co., LP, York, PA (US)

( * ) Notice: Subject to any disclaimer, the term of this patent is extended or adjusted under 35 U.S.C. 154(b) by 181 days.

(21) Appl. No.: 10/370,702

(22) Filed: Feb. 24, 2003

(65) Prior Publication Data

US 2004/0164048 A1 Aug. 26, 2004

(51) Int. Cl.
*B65D 23/10* (2006.01)

(52) U.S. Cl. ..... 215/398; 215/379; 220/771

(58) Field of Classification Search ..... 215/384, 215/385, 396, 398, 10, 379, 382; 220/771, 220/669

See application file for complete search history.

(56) References Cited

U.S. PATENT DOCUMENTS

| | | | | | |
|---|---|---|---|---|---|
| 3,708,082 | A | * | 1/1973 | Platte | 215/385 |
| 4,127,206 | A | * | 11/1978 | Virog et al. | 215/385 |
| 4,372,455 | A | * | 2/1983 | Cochran | 215/385 |
| 4,609,106 | A | * | 9/1986 | Gentili | 206/509 |
| D307,389 | S | * | 4/1990 | Larson | D9/520 |
| 4,969,922 | A | * | 11/1990 | Platte, Sr. | 215/383 |
| D320,344 | S | * | 10/1991 | Larson | D9/520 |
| D332,747 | S | * | 1/1993 | Darr et al. | D9/520 |
| D348,612 | S | * | 7/1994 | Ring | D9/531 |
| D351,347 | S | * | 10/1994 | Ring | D9/528 |
| 5,381,910 | A | * | 1/1995 | Sugiura et al. | 215/398 |
| D360,830 | S | * | 8/1995 | Hestehave et al. | D9/520 |
| D397,036 | S | * | 8/1998 | Katakouzinos | D9/520 |
| 5,833,115 | A | * | 11/1998 | Eiten | 220/669 |
| D409,494 | S | * | 5/1999 | Frazer | D9/520 |
| 6,223,945 | B1 | * | 5/2001 | Giblin et al. | 222/109 |

FOREIGN PATENT DOCUMENTS

JP 410081364 A * 3/1998

* cited by examiner

*Primary Examiner*—Sue A. Weaver
(74) *Attorney, Agent, or Firm*—Venable LLP; James R. Burdett; Stuart I. Smith

(57) ABSTRACT

A plastic container is provided. The plastic container has a base, a body extending upward from the base, a neck extending upward from the body, a finish extending upward from the neck and having an opening, an integral handle having a lower end attached to the body and an upper end attached to the neck, first and second chamfered corners integral with the body and extending upward from the base to the neck, and third and fourth chamfered corners integral with the body and extending upward from the base to a vertical position of the container adjacent the lower end of the handle.

27 Claims, 9 Drawing Sheets

PLASTIC CONTAINER HAVING CHAMFERED CORNERS FOR IMPROVED TOP-LOADING STRENGTH

BACKGROUND OF THE INVENTION

The invention relates to a container. More particularly, the invention relates to the structure of a container for liquids.

Recent increases in bulk purchasing have created a demand for large-size containers. Many products, including liquids, are now sold to the consuming public in plastic containers that can be as large as 128 fluid ounces. Larger containers that hold heavy fluids, including beverages, home products, motor oil, or the like, must have a structure strong enough to withstand several different forces. Such forces include, for example, those that result from the weight of the fluid itself, rough handling during transportation, stacking during storage, and being dropped. Finally, large beverage containers that are filled by the hot-fill process must be structurally sound to withstand various forces relating to that process.

Some containers are cold-filled, while others are hot-filled. The hot-fill process is the procedure by which containers are filled with a beverage at a high temperature and capped soon thereafter. As the beverage cools within the container, stresses and strains develop in the container due to changes in the volume of the contents.

A container that is commonly used in the hot-fill process is the polyolefin continuous extrusion blow-molded container. Polyolefin continuous extrusion blow-molded container's are multi-layer containers that provide the requisite structure and barriers to oxygen and oils, for example. These multi-layered containers typically include an exterior layer of polypropylene or polyethylene as the main structure providing layer. Other layers can include oxygen barrier layers, moisture barrier layers, and regrind layers to provide the necessary barrier structures as well as adhesion between the layers.

It will be understood that to form a polyolefin continuous extrusion blow-molded plastic container, a parison can be heated in an extruder, captured by a mold, and blown in the mold. Specifically, to form the cavity of the container, a parison can be extruded up into the mold and as the mold comes together, a pneumatic blow pin, for example, can pierce the parison and blow the parison up against the walls of the mold. The mold typically contains flash pockets above and below the cavity in the mold to capture the excess of the parison that is forced above and below the cavity. When the parison is blown inside the mold, it is forced into the flash pockets and portions of the parison must adhere together. The excess flash can then be cut away from the container after it is ejected from the mold.

There is a need for a large container having a structure that can withstand, in particular, the top load forces that result from stacking of multiple layers of filled containers. In the case of hot-filled containers particularly, the structures should be capable of accommodating variations in volume of the containers' contents and changes of pressure and temperature. Furthermore, the structure should be capable of being manufactured in conventional high-speed equipment.

SUMMARY OF THE INVENTION

The ability to withstand vertical loading on the finish of a container such as container 10 (referred to as top loading) is important in that it determines how many layers of containers can be stacked without causing the container to collapse or deform. A higher top load strength allows more vertical stacking of containers for shipping and storage, which can reduce shipping and storage costs. A higher top load strength also reduces the chance of deformation or rupturing due to rough handling or dropping. The invention provides a structure that has an increased top load strength compared to other structures having a similar weight. Alternatively, the invention can provide a lighter container for a given top load strength.

Embodiments of the invention provide a plastic container having a base, a body extending upward from the base, a neck extending upward from the body, a finish extending upward from the neck and having an opening, an integral handle having a lower end attached to the body and an upper end attached to the neck, first and second chamfered corners integral with the body and extending upward from the base to the neck, and third and fourth chamfered corners integral with the body and extending upward from the base to a vertical position of the container adjacent the lower end of the handle.

Other embodiments of the invention provide a blow molded plastic container having a base, a body extending upward from the base, a neck extending upward from the body, a finish extending upward from the neck and having an opening, an integral handle having a lower end attached to the body and an upper end attached to the neck, first and second chamfered corners integral with the body and extending upward from the base to the neck, and third and fourth chamfered corners integral with the body and extending upward from the base to a vertical position of the container adjacent the lower end of the handle.

Still other embodiments of the invention provide a plastic container having a base, a body extending upward from the base, a neck extending upward from the body, a finish extending upward from the neck and having an opening, and an integral handle having a lower end attached to the body and an upper end attached to the neck. A horizontal cross section of the container at a vertical position below the lower end of the handle is an octagon. The octagon has a first pair of opposite sides and a second pair of opposite sides. The first pair of opposite sides has no common edge with either of the second pair of opposite sides. The first pair of opposite sides has a first length and the second pair of opposite sides has a second length longer than the first length.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
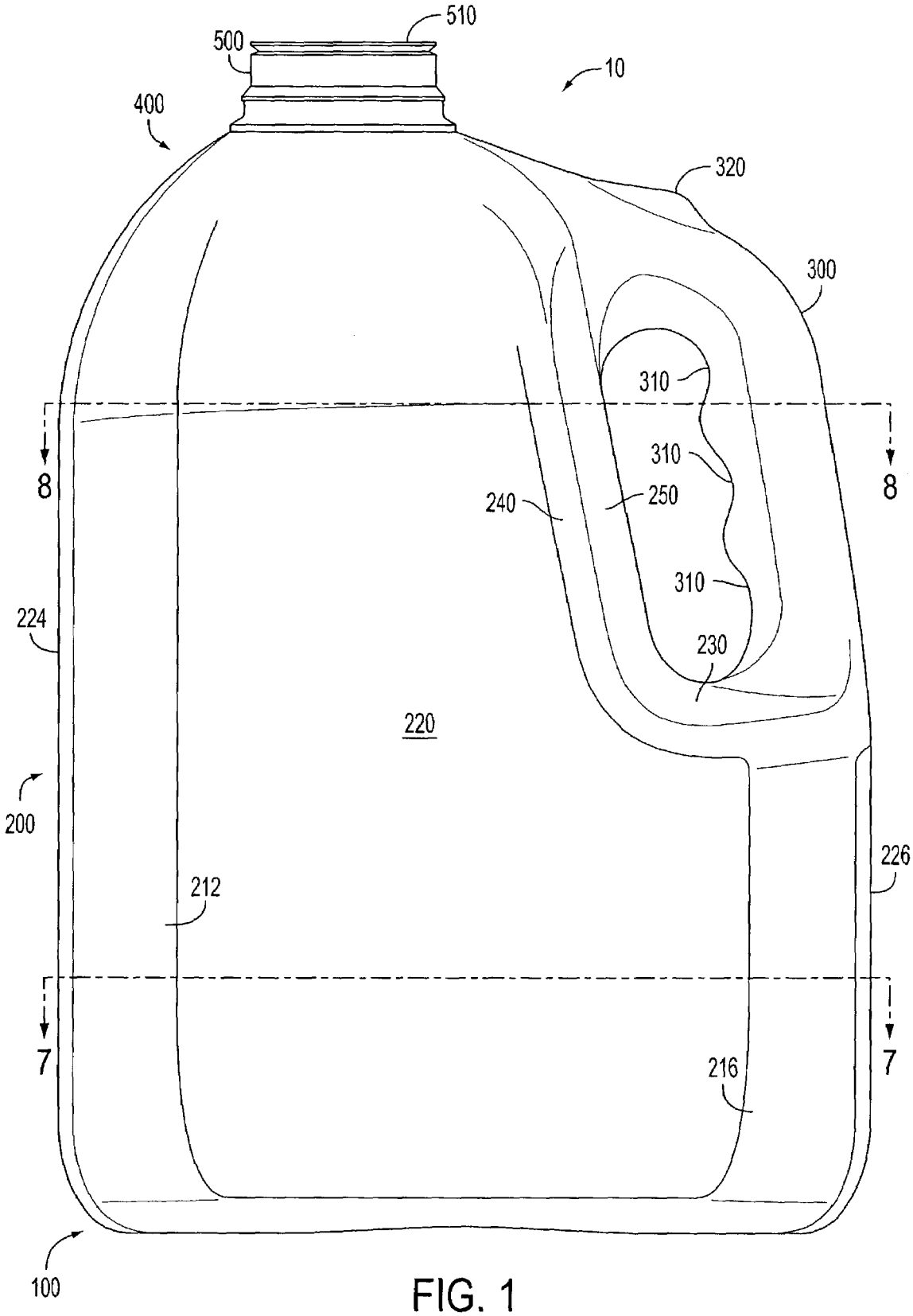
FIG. 1 is a left side view of a first embodiment of the invention.
Figure 2:
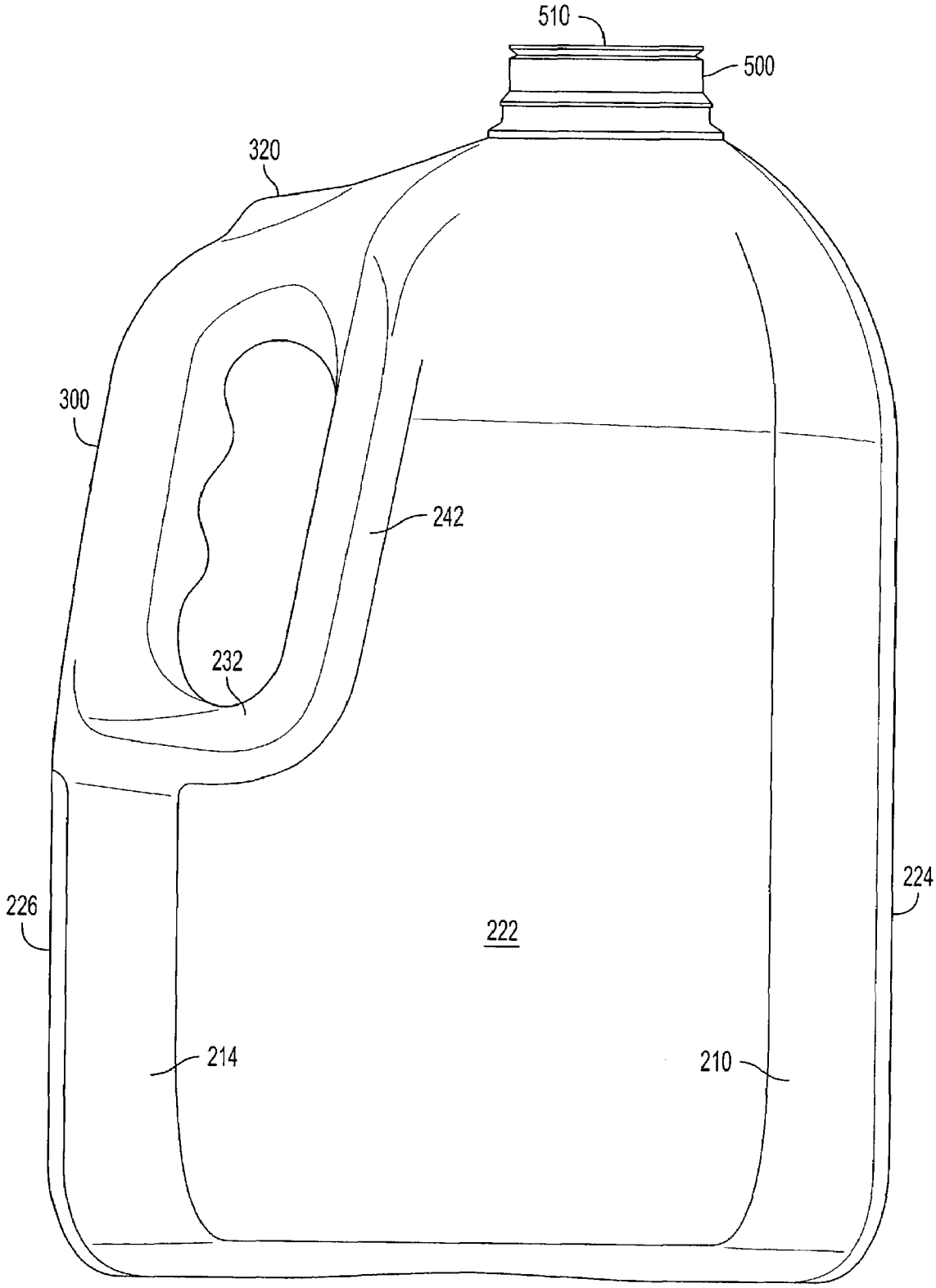
FIG. 2 is a right side view of the first embodiment of the invention.
Figure 3:
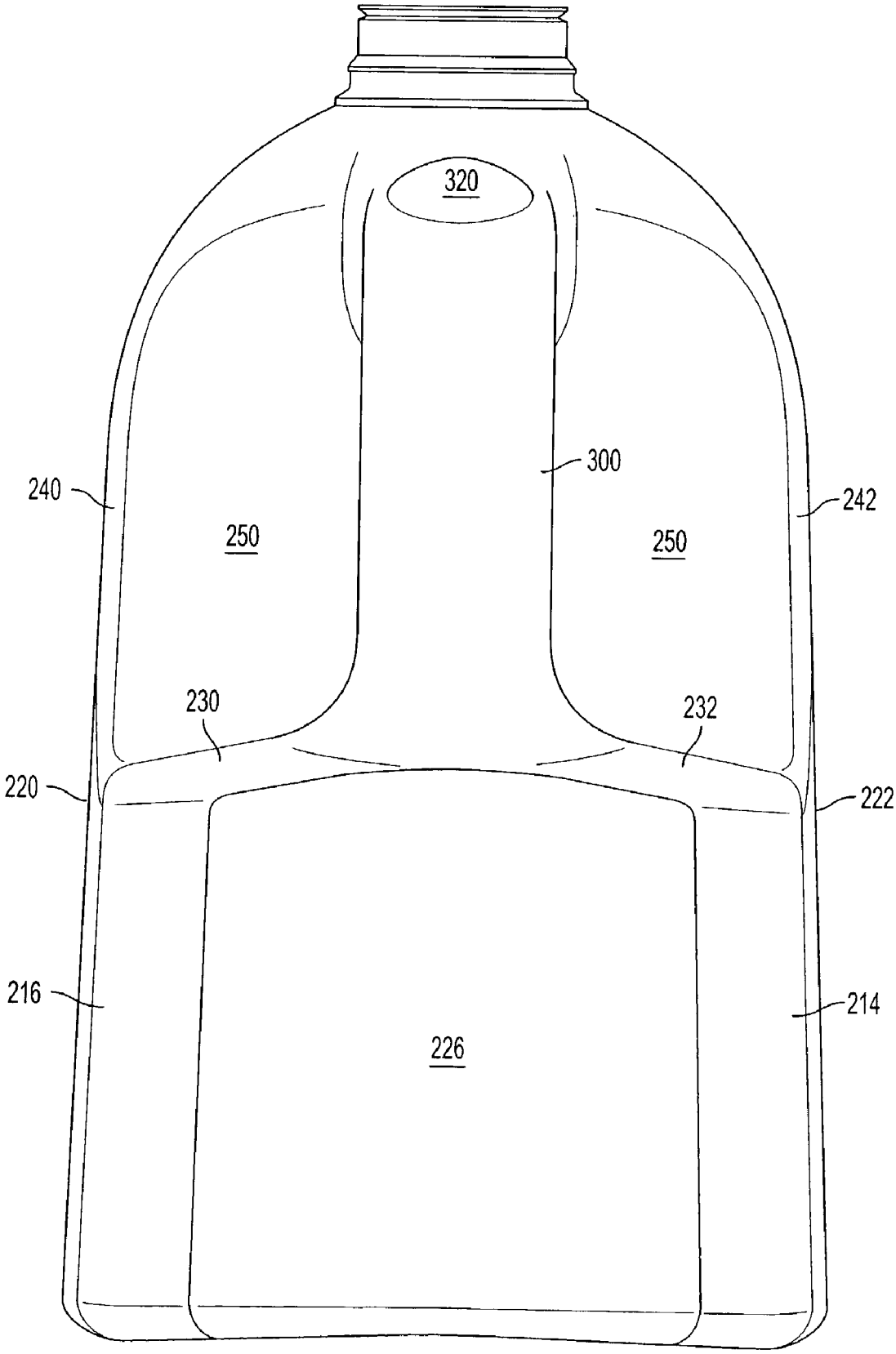
FIG. 3 is a rear view of the first embodiment of the invention.
Figure 4:
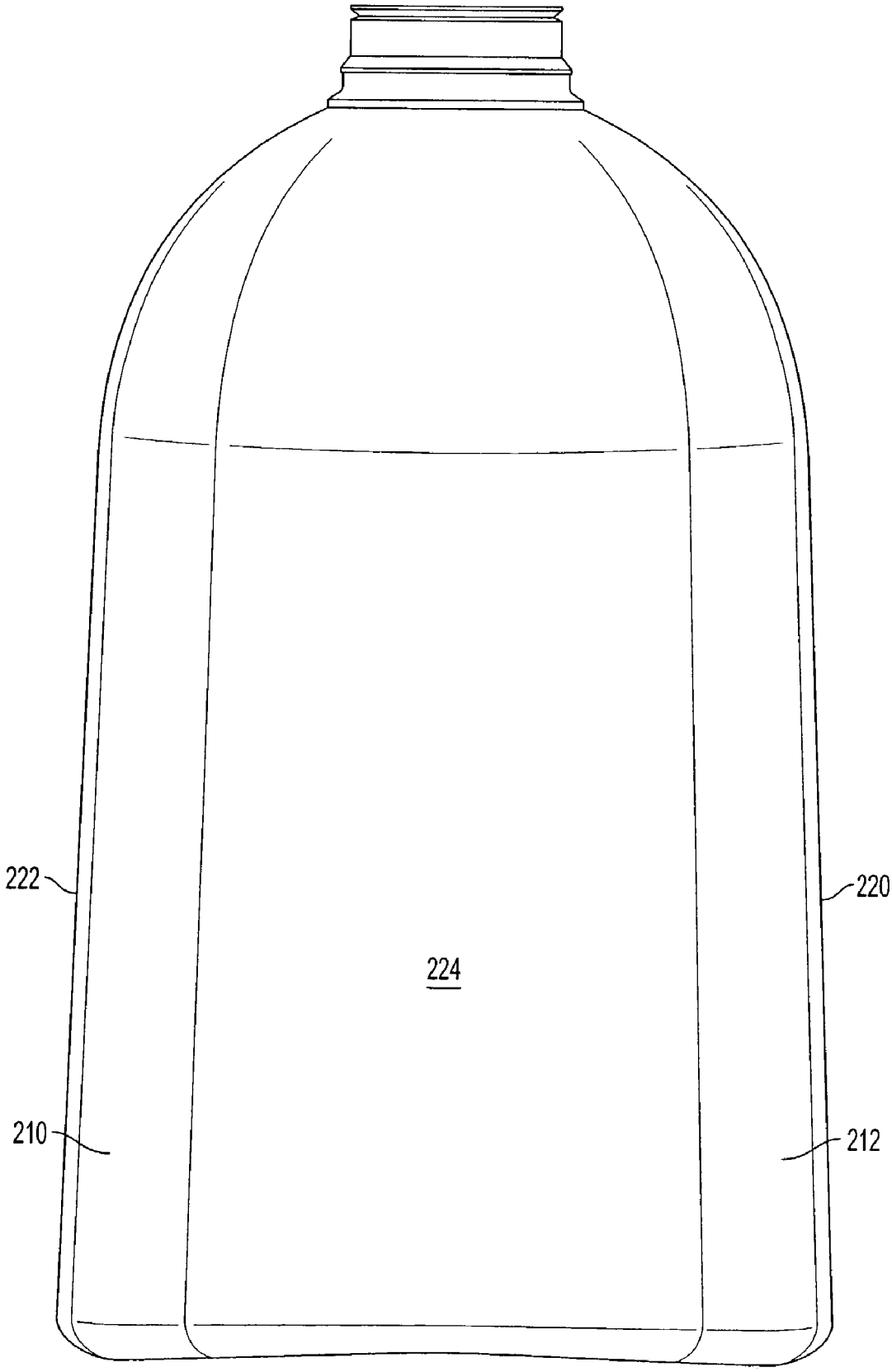
FIG. 4 is a front view of the first embodiment of the invention.
Figure 5:
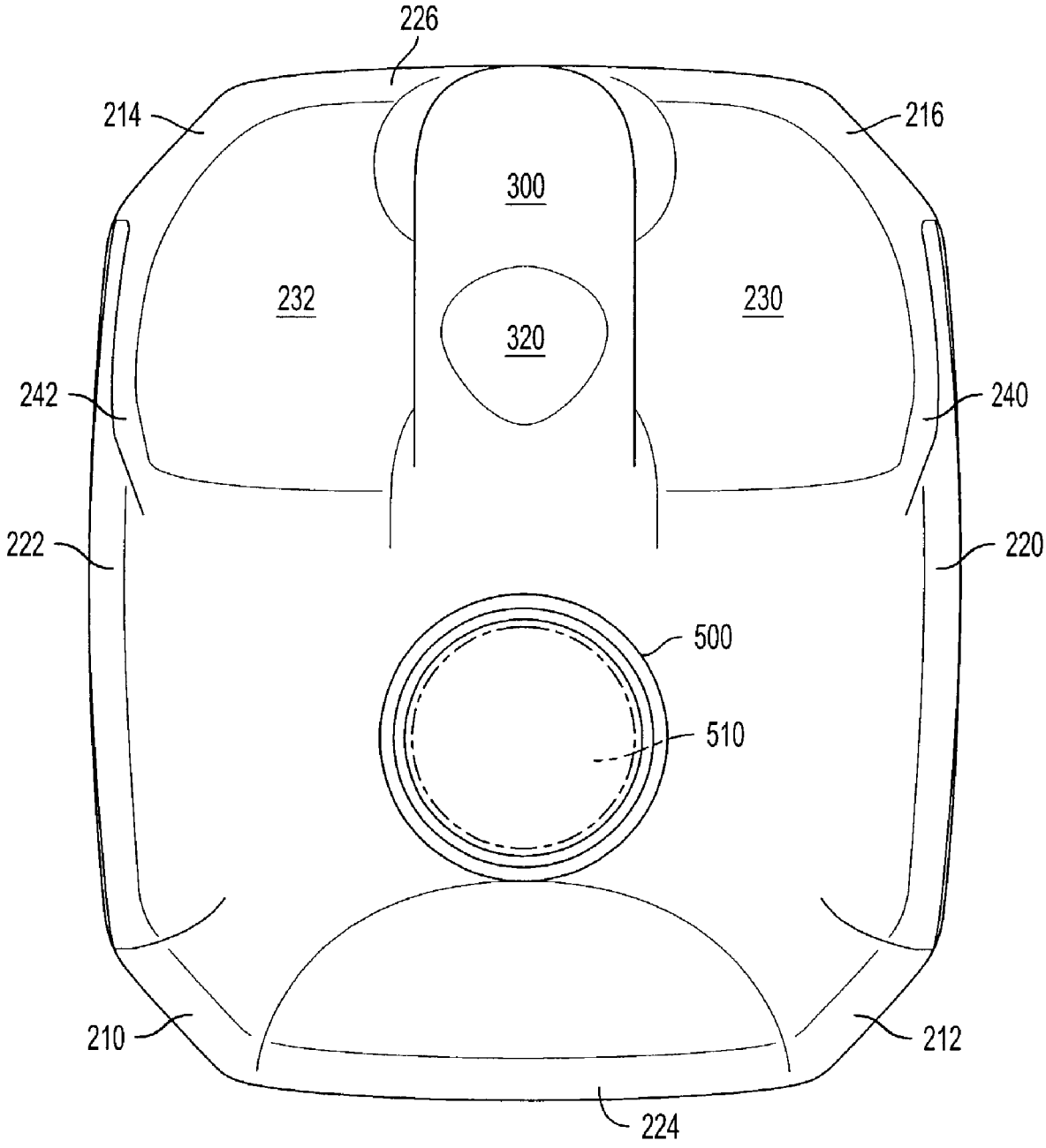
FIG. 5 is a top view of the first embodiment of the invention.

The invention is explained in the following with the aid of the drawings in which like reference numbers represent like elements.

FIGS. 1–4 show a container 10 that is an example of an embodiment of the invention that can be used as a large container for liquids such as, for example, 128 fluid ounces of orange juice. Container 10 has a base 100 and a neck 400 connected to each other by a body 200. At the upper end of neck 400 is a finish 500 having an opening 510. In this example, finish 500 is configured to receive a press-fit top for sealing container 10. A handle 300 is provided to make it easier for a user to hold container 10 during transport and while pouring the contents from container 10. In this example, handle 300 has several finger indentations 310 and a thumb mound 320 to make handle 300 more comfortable to the user and to provide the user with more control while gripping container 10.

Container 10 has a generally rectangular cross sectional shape, as shown in FIGS. 5–8. This generally rectangular shape is created by two side panels 220, 222, a front panel 224, and a lower rear panel 226. However, these panels do not join each other at 90° corners but, instead, chamfered corners are provided. Side panel 220 is connected to front panel 224 and lower rear panel 226 by front chamfered corner 212 and rear chamfered corner 216, respectfully. Similarly, side panel 222 is attached to front panel 224 and lower rear panel 226 by front chamfered corner 210 and rear chamfered corner 214, respectfully. As shown in the figures, lower rear panel 226 and rear chamfered corners 214, 216 do not extend the entire height of container 10. Lower rear panel 226 and rear chamfered corners 214, 216 terminate at the base of handle 300. Substantially horizontal surfaces 230, 232 extend from rear chamfered corners 216, 214, respectfully, around the base of handle 300 and transition into an upper rear panel 250. Upper rear panel 250 is connected to side panels 220, 222 by rounded corners 240, 242, respectfully.

Figure 6:
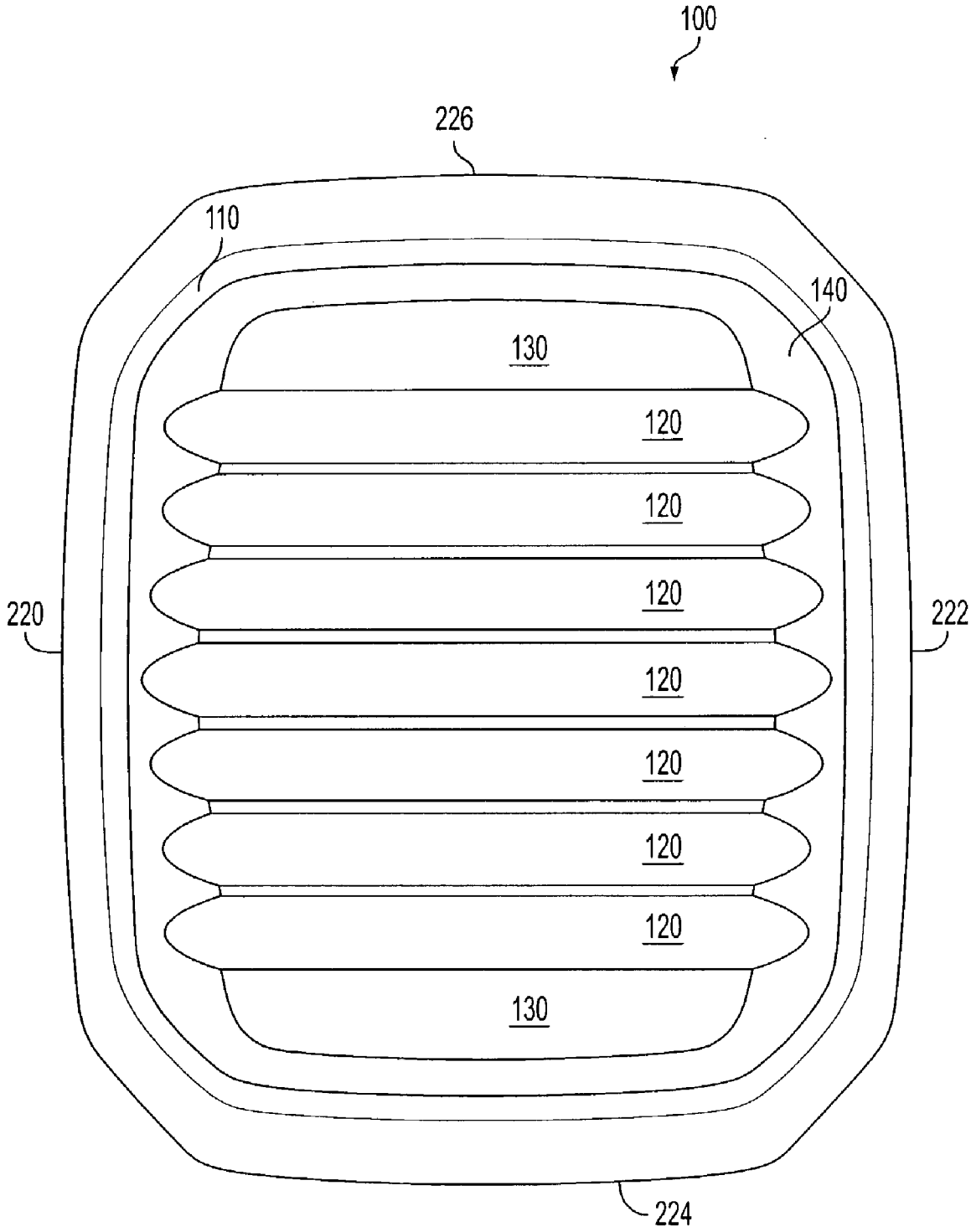
FIG. 6 is a bottom view of the first embodiment of the invention.

FIG. 6 shows an example of the structure of base 100. At base 100, side panels 220, 222, front panel 224, lower rear panel 226, front chamfered corners 210, 212, and rear chamfered corners 214, 216 transition into a contact area 110. Contact area 110 is connected to a substantially planar base panel 130 by a transition 140. Contact area 110 can be designed such that all points of contact area 110 contact a support surface on which container 10 is placed. Alternatively, some portion less than all points of contact area 110 can contact the support surface. A number of corrugations 120 (in this example seven) provide structural rigidity to base panel 130. FIG. 6 shows only one example of base 100. It is noted that other base structures can be used as long as the structures are sufficiently strong to support the contents of container 10 while preventing unacceptable sagging.

Figure 7:
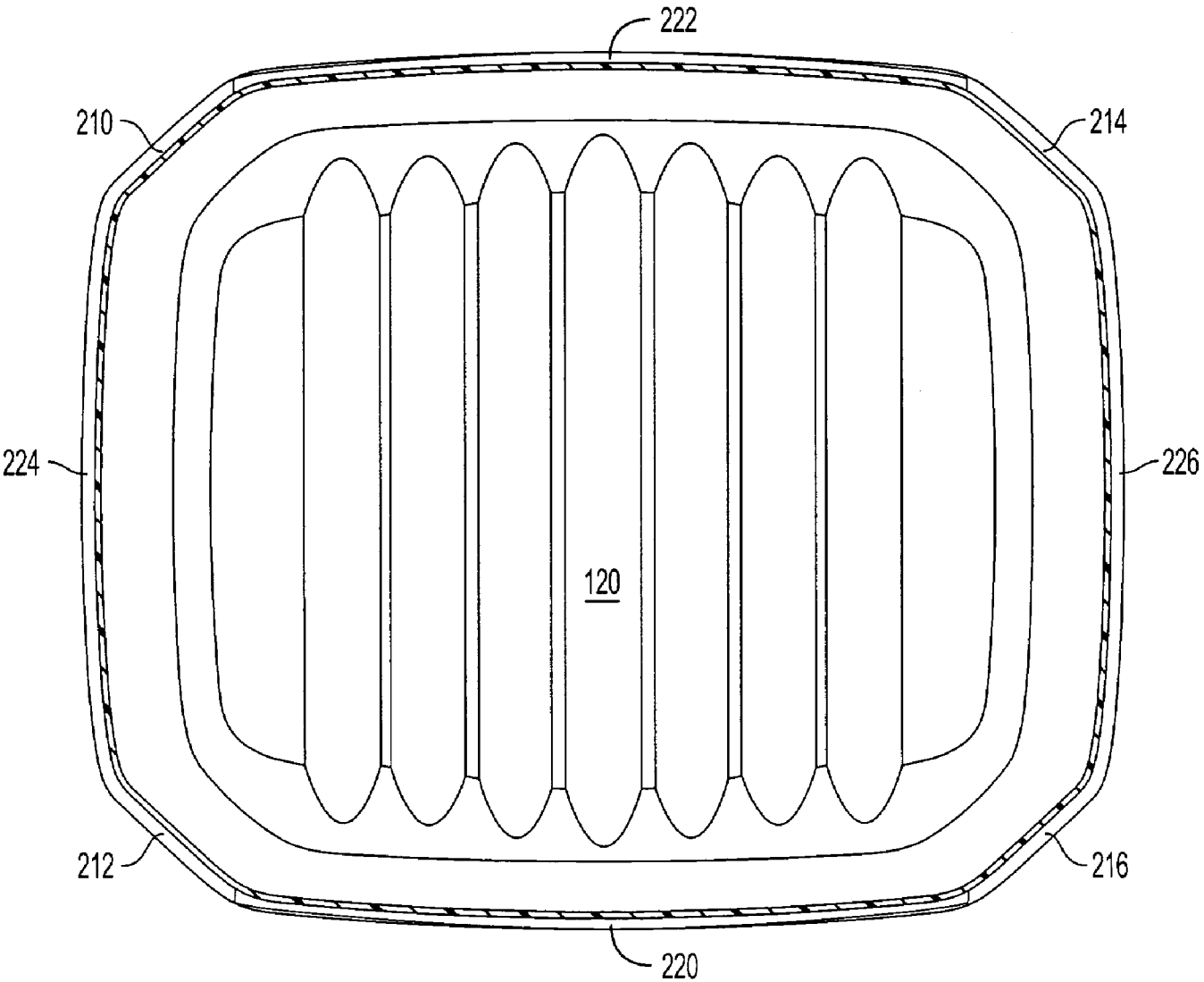
FIG. 7 is a sectional view of the first embodiment of the invention taken along section line 7—7 in FIG. 1.
Figure 8:
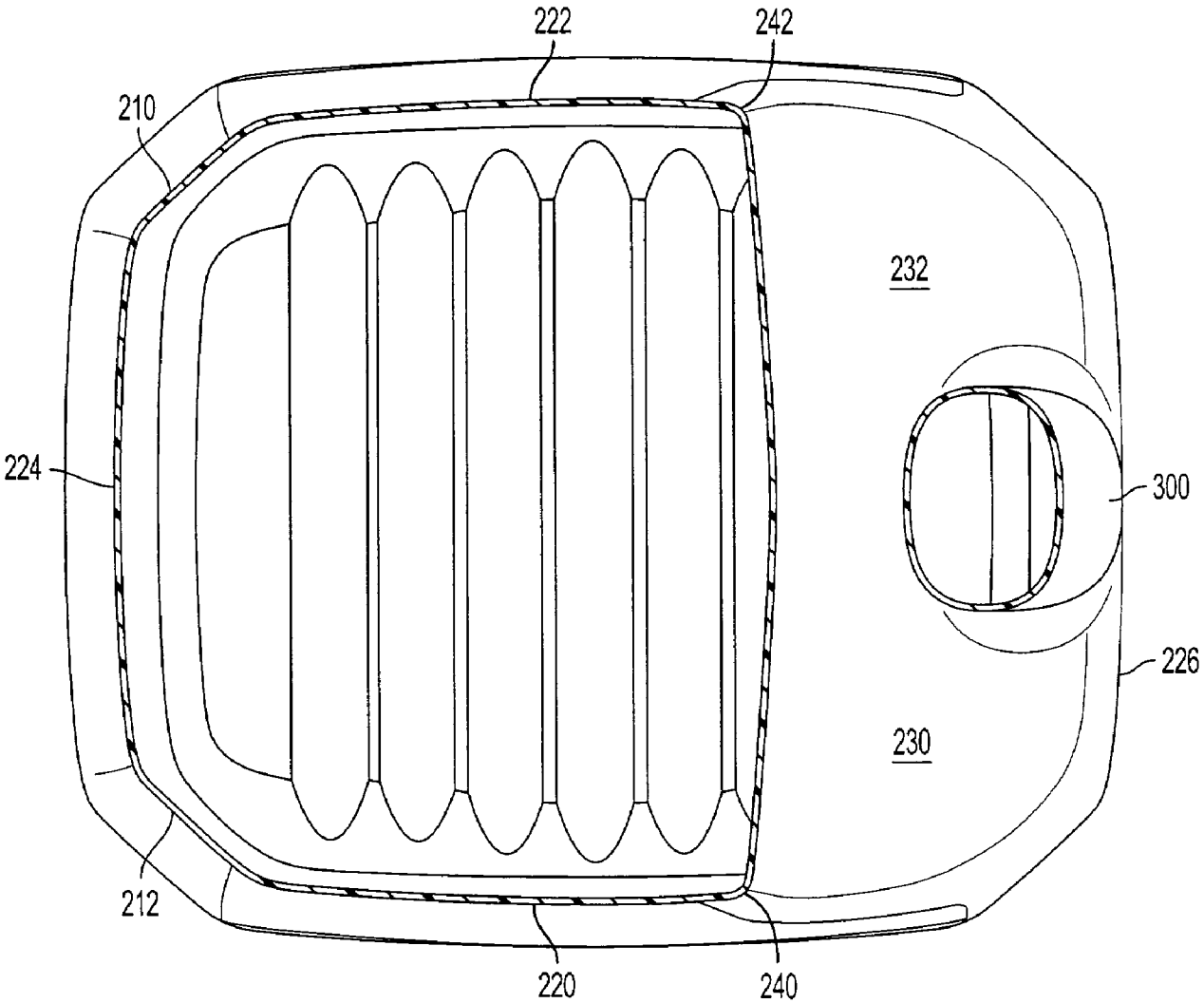
FIG. 8 is a sectional view of the first embodiment of the invention taken along section line 8—8 in FIG. 1.

FIG. 7 shows a cross sectional cut through a lower portion of container 10 along section line 7—7 in FIG. 1. This figure shows more clearly the shape of chamfered corners 210, 212, 214, 216 and their relation to side panels 220, 222, front panel 224, and lower rear panel 226. The inside of base 100 is also shown in FIG. 7. FIG. 8 shows a cross sectional cut through an upper portion of container 10 along section line 8—8 in FIG. 1. This figure shows that front chamfered corners 210, 212 and front panel 224 continue vertically higher than do rear chamfered corners 214, 216 and lower rear panel 226.

Figure 9:
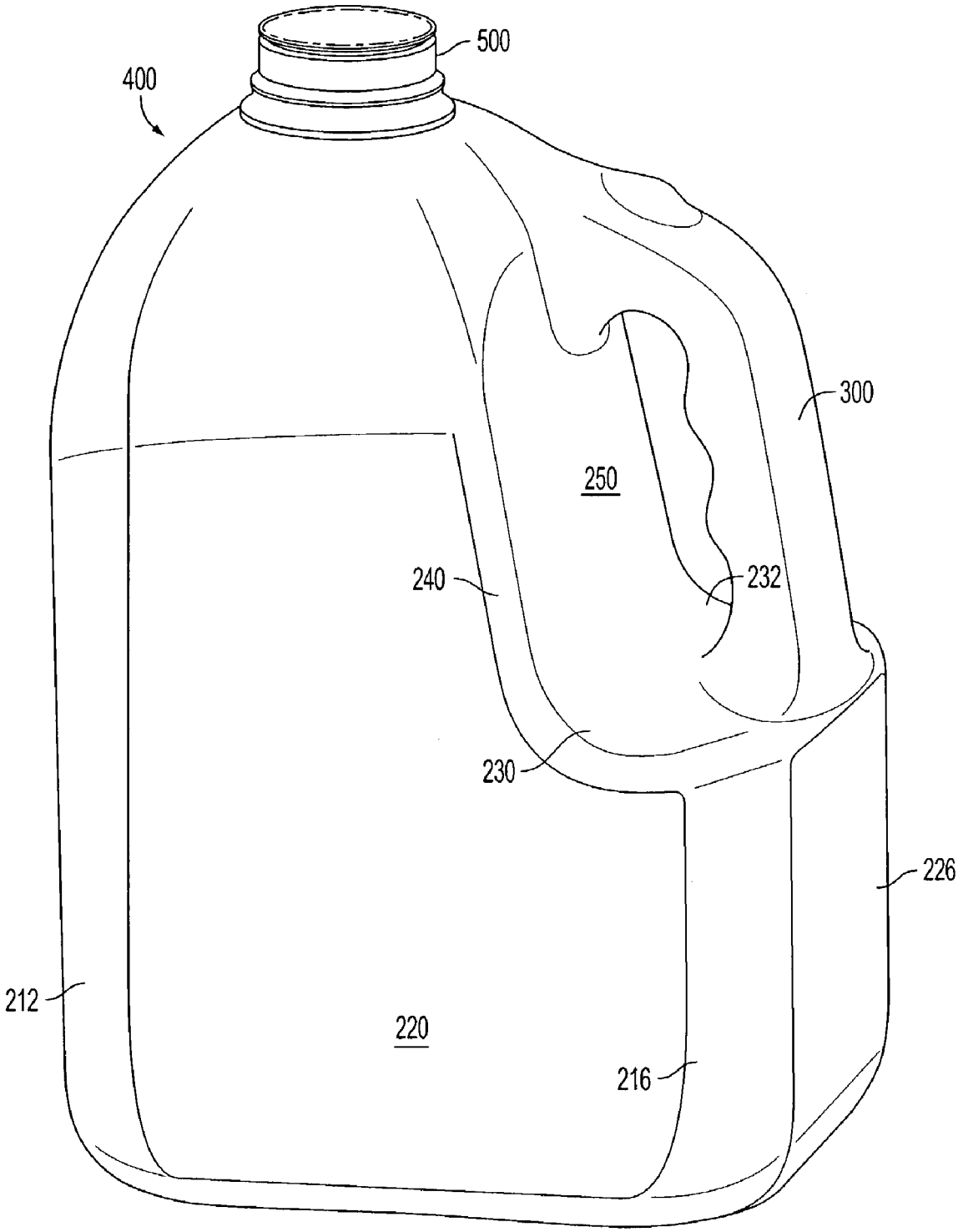
FIG. 9 is a perspective view of the first embodiment of the invention.

FIG. 9 shows a perspective view of container 10 that shows the transition neck 400 makes from finish 500 to front chamfered corners 210, 212, side panels 220, 222, front panel 224, rounded corners 240, 242, upper rear panel 250, and handle 300. An advantage of the invention over other large liquid containers is the longitudinal (vertical) strength provided to container 10 by this structure. As stated above, top load strength is important in that it determines how many layers of containers can be stacked without causing the container to collapse or deform. A higher top load strength allows more vertical stacking of containers for shipping and storage, which can reduce shipping and storage costs. A higher top load strength also reduces the chance of deformation or rupturing due to rough handling or dropping.

A vertical load experienced by finish 500 of container 10 is predominantly transferred to base 100 through five structural paths. The portion of the load carried by the front of container 10 is transferred mainly through front chamfered corners 210, 212. The portion of the load carried by the rear of container 10 is transferred mainly through handle 300 and rounded corners 240, 242 and then through rear chamfered corners 214, 216. Using chamfered corners instead of normal rounded corners for chamfered corners 210, 212, 214, 216 provides stronger corners and, as a result, increased top load strength. In addition, chamfered corners help avoid the problem of thin blown corners that can result from blow molding small radius corners.

In particular embodiments of the invention, the first and second chamfered corners each comprise a substantially flat surface having a horizontal dimension that is at least 10 to 15 percent of the longest dimension of the substantially rectangular horizontal cross section of container 10.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A plastic container, comprising:

a base;

a body extending upward from the base;

a neck extending upward from the body;

a finish extending upward from the neck and having an opening;

an integral handle having a lower end attached to the body and an upper end attached to the neck;

first and second chamfered corners integral with the body and extending upward from the base to the neck, each of the first and second chamfered corners being substantially smooth and uninterrupted along its entire length; and third and fourth chamfered corners integral with the body and extending upward from the base to a vertical position of the container adjacent the lower end of the handle.

2. The container of claim 1, wherein the container is adapted to distribute top load through the neck onto the first and second chamfered corners and the handle.

3. The container of claim 1, wherein a horizontal cross section through the body at the first, second, third and fourth chamfered corners is substantially a rectangle with chamfered corners.

4. The container of claim 3, wherein the first and second chamfered corners each comprise a substantially flat surface having a horizontal dimension that is at least 10 percent of a longest dimension of the substantially rectangular horizontal cross section.

5. The container of claim 4, wherein the horizontal dimension of the substantially flat surface is at least 15 percent of the longest dimension of the substantially rectangular horizontal cross section.

6. The container of claim 1, wherein the handle is tubular.

7. The container of claim 1, wherein the base comprises at least one contact region for contacting a supporting surface on which the container can be supported; and a plurality of strengthening ribs.

8. The container of claim 7, wherein the plurality of strengthening ribs are parallel to each other.

9. The container of claim 1, wherein the container is a 128 ounce liquid container.

10. The container of claim 1, further comprising two upper rounded corners, one of the upper rounded corners being located on each side of the upper end of the handle, the two upper rounded corners extending upward from the body into the neck.

11. The container of claim 10, wherein the container is adapted to distribute top load through the neck onto the first and second chamfered corners, the two upper rounded corners and the handle.

12. The container of claim 10, wherein a horizontal cross section through the body at the first, second, third and fourth chamfered corners is substantially a rectangle with chamfered corners.

13. The container of claim 12, wherein the first and second chamfered corners each comprise a substantially flat surface having a horizontal dimension that is at least 10 percent of a longest dimension of the substantially rectangular horizontal cross section.

14. The container of claim 13, wherein the horizontal dimension of the substantially flat surface is at least 15 percent of the longest dimension of the substantially rectangular horizontal cross section.

15. The container of claim 10, wherein the handle is tubular.

16. The container of claim 10, wherein the base comprises at least one contact region for contacting a supporting surface on which the container can be supported; and a plurality of strengthening ribs.

17. The container of claim 16, wherein the plurality of strengthening ribs are parallel to each other.

18. The container of claim 10, wherein the container is a 128 ounce liquid container.

19. The container of claim 1, wherein a vertically highest point on the handle is no higher than a vertically lowest point of the finish.

20. The container of claim 1, wherein each of the first and second chamfered corners is uninterrupted by a step or a groove.

21. The container of claim 1, wherein each of the third and fourth chamfered corners is substantially smooth and uninterrupted along its entire length.

22. A blow molded plastic container, comprising:

a base;

a body extending upward from the base;

a neck extending upward from the body;

a finish extending upward from the neck and having an opening;

an integral handle having a lower end attached to the body and an upper end attached to the neck;

first and second chamfered corners integral with the body and extending upward from the base to the neck, each of the first and second chamfered corners being substantially smooth and uninterrupted along its entire length; and third and fourth chamfered corners integral with the body and extending upward from the base to a vertical position of the container adjacent the lower end of the handle.

23. The blow molded plastic container of claim 22, further comprising two upper rounded corners, one of the upper rounded corners being located on each side of the upper end of the handle, the two upper rounded corners extending upward from the body into the neck.

24. The blow molded plastic container of claim 22, wherein the handle is tubular.

25. The container of claim 22, wherein a vertically highest point on the handle is no higher than a vertically lowest point of the finish.

26. The container of claim 22, wherein each of the first and second chamfered corners is uninterrupted by a step or a groove.

27. The container of claim 22, wherein each of the third and fourth chamfered corners is substantially smooth and uninterrupted along its entire length.

* * * * *